US012391461B2

(12) United States Patent
Lin et al.

(10) Patent No.: US 12,391,461 B2
(45) Date of Patent: Aug. 19, 2025

(54) SHEET PRODUCT PACKAGE AND METHOD OF MAKING DISPENSABLE SHEET PRODUCT

(71) Applicant: Inteplast Group Corporation, Livingston, NJ (US)

(72) Inventors: Chunming Lin, Xingang Township (TW); Kangbin Zheng, Li County (CN); Bin Liu, Gang Lidian Township (CN)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 18/661,241

(22) Filed: May 10, 2024

(65) Prior Publication Data

US 2024/0294324 A1 Sep. 5, 2024

Related U.S. Application Data

(63) Continuation of application No. 17/387,392, filed on Jul. 28, 2021, now Pat. No. 12,006,129.

(51) Int. Cl.

| | |
|---|---|
| ***B65H 45/24*** | (2006.01) |
| ***B65D 83/08*** | (2006.01) |
| ***B65H 35/00*** | (2006.01) |

(52) U.S. Cl.

CPC ..... *B65D 83/0805* (2013.01); *B65H 35/0006* (2013.01); *B65D 2583/08* (2013.01);

(Continued)

(58) Field of Classification Search

CPC ..... B65H 2301/5132; B65H 45/24; B65H 35/0006; B65H 2301/515;

(Continued)

(56) References Cited

U.S. PATENT DOCUMENTS

| | | | |
|---|---|---|---|
| 2,826,230 A | 3/1958 | Conell | |
| 5,228,373 A | 7/1993 | Welsch | |

(Continued)

FOREIGN PATENT DOCUMENTS

| | | | | |
|---|---|---|---|---|
| CN | 108002102 A | * | 5/2018 | ..... B65H 35/06 |
| JP | 2012034868 A | * | 2/2012 | |

OTHER PUBLICATIONS

Zhu Zhifeng, Qian Kun; "Effects of the Molecular Structure of Polyvinyl Alcohol on the Adhesion to Fibre Substrates"; Fibres & Textiles in Eastern Europe, vol. 15, No. 1; Jan./Mar. 2007 (Year: 2007), 4 pages.

*Primary Examiner* — Patrick H Mackey

(74) *Attorney, Agent, or Firm* — Stinson LLP

(57) ABSTRACT

A sheet product package and method of making discrete plastic sheets includes a package enclosure with a dispensing opening structure and a plurality of discrete plastic sheets arranged in a stack. The plurality of discrete plastic sheets are disposed within the package enclosure, and each of the plurality of discrete plastic sheets is electrostatically charged. In the method of making the dispensable plastic sheets, electrostatically charged discrete plastic sheets are formed and arranged in a stack. The method may include forming a continuous plastic film, cutting the continuous plastic film into discrete plastic sheets, and, after cutting, electrostatically charging the discrete plastic sheets.

15 Claims, 5 Drawing Sheets

(52) U.S. Cl.
CPC ..... *B65H 2301/5132* (2013.01); *B65H 2301/515* (2013.01); *B65H 2701/1752* (2013.01)

(58) Field of Classification Search
CPC ..... B65H 2701/1752; B65D 83/0817; B65D 83/0805; B65D 2583/08
USPC ..... 270/39.06, 39.07
See application file for complete search history.

(56) References Cited

U.S. PATENT DOCUMENTS

| | | | | |
|---|---|---|---|---|
| 5,655,682 | A | 8/1997 | Hoffrichter | |
| 6,015,257 | A | 1/2000 | Hahne et al. | |
| 6,409,044 | B1 | 6/2002 | Brown et al. | |
| 6,575,329 | B2 | 6/2003 | Clark | |
| 6,646,853 | B2 | 11/2003 | Jacobs et al. | |
| 7,066,422 | B1 | 6/2006 | Slocum | |
| 7,273,193 | B2 | 9/2007 | Slocum et al. | |
| 8,559,156 | B2 * | 10/2013 | Soffa ..... | B65H 37/04 361/225 |
| 9,738,434 | B2 | 8/2017 | Fujimoto | |
| 2003/0136793 | A1 | 7/2003 | Chen | |
| 2005/0077171 | A1 | 4/2005 | Hagemann et al. | |
| 2005/0199643 | A1 | 9/2005 | Smiley et al. | |
| 2012/0279981 | A1 | 11/2012 | Thomas et al. | |
| 2020/0391932 | A1 | 12/2020 | Tsuchida et al. | |

* cited by examiner

SHEET PRODUCT PACKAGE AND METHOD OF MAKING DISPENSABLE SHEET PRODUCT

STATEMENT OF RELATED CASES

This application is a continuation of U.S. application Ser. No. 17/387,392, filed Jul. 28, 2021, the entire contents of which are incorporated herein by reference.

FIELD

The present disclosure generally relates to dispensable plastic sheets and more particularly to packages of discrete plastic sheets and methods of making plastic sheets that facilitate dispensing of the discrete plastic sheets one-at-a-time.

BACKGROUND

Dispensable sheet products such as tissue paper, deli paper, and wet wipes are in wide use. Dispensable plastic sheet products comprise discrete sheets of material that are stacked in an interfolded stack, wherein the stack is placed into a package enclosure, such as a box or film enclosure, with an opening through which individual stacks may be dispensed, one-at-a-time. Dispensable sheet products may be formed of various materials, including paper and plastic.

SUMMARY

The present disclosure discloses a sheet product package. The sheet product package comprises a package enclosure including a dispensing opening structure and a plurality of discrete plastic sheets arranged in a stack. The plurality of discrete plastic sheets are disposed within the package enclosure, and each of the plurality of discrete plastic sheets is electrostatically charged.

In another aspect of the present disclosure, a method of making the dispensable plastic sheets comprises forming electrostatically charged discrete plastic sheets and arranging the electrostatically charged discrete plastic sheets in a stack. The method further includes forming a continuous plastic film, cutting the continuous plastic film into discrete plastic sheets, and, after cutting, electrostatically charging the discrete plastic sheets.

Other objects and features of the present disclosure will be in part apparent and in part pointed out herein.

DETAILED DESCRIPTION

The present inventors have recognized that existing sheets made of plastic, such as deli scale sheets, do not dispense as well as paper sheets. In comparison with plastic deli scale sheets, dispensable paper sheets generally have a higher friction coefficient (COF) and lower density. Because of this, for paper sheets, packages have been devised with very small dispensing openings. The first sheet in the stack is partially pulled through the opening and is substantially compressed by the package in the opening. To dispense the sheet from the package, the first sheet is pulled fully out of the dispensing opening. As the first sheet comes out of the dispensing opening, it clings to the second sheet immediately below it in the stack and pulls the second sheet partially through the opening. The package constricts the second sheet within the opening sufficiently to cause the first sheet to release from the second sheet. Thus, after the first sheet is fully dispensed, the second sheet is held in the package in a ready-to-dispense configuration. Because plastic deli scale sheets have lower COF, higher density, filler content, and higher weight per unit area, they will not draw through the dispensing opening and release to consistently dispense one-sheet-at-a-time in the same way that paper dispensable sheets do.

In general, the inventors have recognized that discrete plastic sheets (e.g., deli scale sheets) can be made to reliably dispense one-at-a-time through a dispensing opening in a housing by imparting electrostatic charge to plastic sheets and, optionally, by designing the dispensing opening to have a particular size and shape that promotes the electrostatically charged sheets dispensing one-at-a-time through the dispensing opening. Various types of dispensable discrete plastic sheets can be used without departing from the scope of this disclosure. In an exemplary embodiment, the discrete plastic sheets are 'deli paper' sheets. In one or more embodiments, the electrostatically charged discrete plastic sheets are comprised of a polyolefin material. Sheets in accordance with this disclosure may have a density of greater than 0.9 g/cm3 (preferably greater than 1.0 g/cm3, further greater than 1.2 g/cm3, further greater than 1.4 g/cm3), a weight per unit area in a range of from about 50 to 200 g/m$^2$ (preferably, a range from 100 to 150 g/m$^2$), and/or a filler content of 5-80%.

Figure 1:
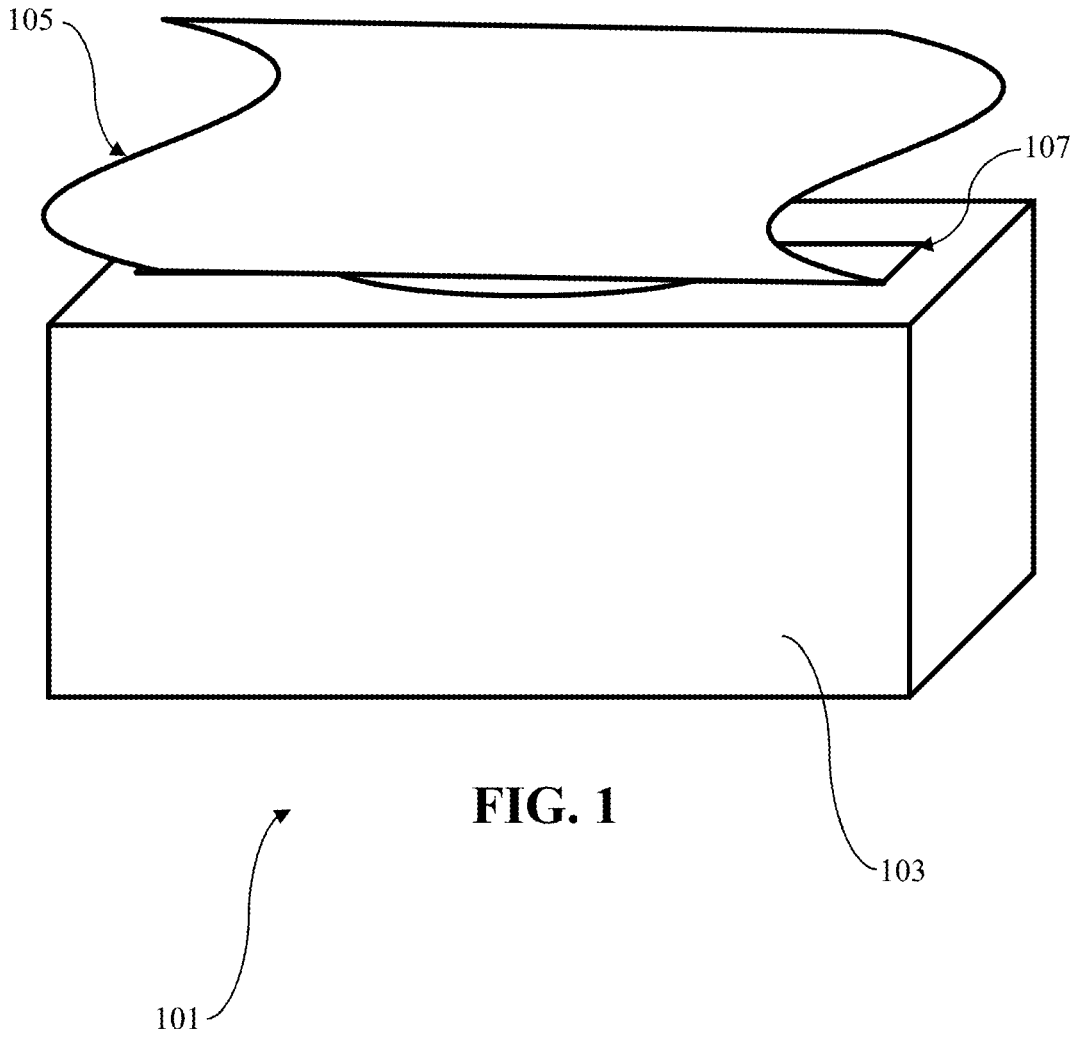
FIG. 1 is a perspective of a sheet package product with a discrete plastic sheet in a ready-to-dispense configuration.
Figure 2:
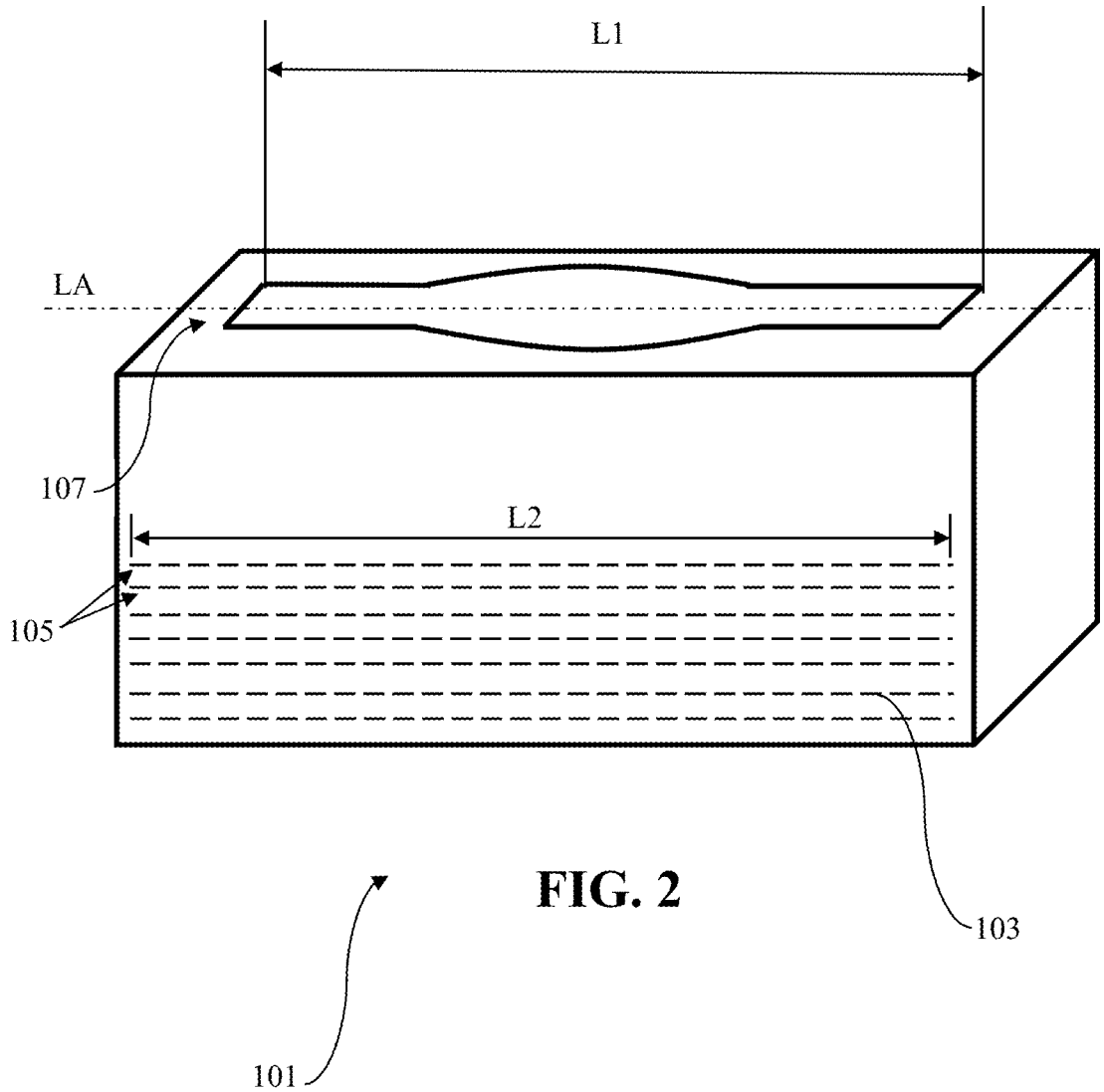
FIG. 2 is a perspective of sheet product package.

Referring now to FIGS. 1 and 2, an exemplary embodiment of a sheet product package is generally indicated at reference number 101. The sheet product package 101 broadly comprises a package enclosure 103 and a stack of discrete plastic sheets 105 disposed in the package enclosure. In the illustrated embodiment, the package enclosure 103 comprises a cardstock box, but it will be understood that other types of package enclosures such film or paper wrappings, etc., may also be used without departing from the scope of the disclosure. The package enclosure 103 generally defines an interior space in which to receive the stack of discrete plastic sheets 105. FIG. 2 shows a stack of sheets 105 in the interior of the package enclosure 103 using broken lines to represent the sheets. The package enclosure 103 broadly comprises dispensing opening structure 107 configured to define a dispensing opening through which the discrete plastic sheets 105 may be dispensed one-at-a-time from the package 101.

The term "dispensing opening structure" is used in this disclosure to define pre-formed openings in the package enclosure 103 or other structures formed in the package enclosure for defining a dispensing opening at the time of use. For instance, in one or more embodiments, the dispensing opening structure 107 comprises a tear-out panel defined by a line of perforations or other tear line structure formed in a wall of the package enclosure. In the illustrated embodiment, the dispensing opening structure 107 is configured to define an elongate opening having a length L1 extending along a longitudinal axis LA. In this disclosure, "dispensing opening" refers to the smallest opening through which the pre-formed sheets pass when being dispensed. So if the package enclosure were constructed like a conventional tissue body (not shown) with a tear-out cardboard pocket that revels a film gland with a narrower slit than the cardboard tear-out, the slit in the film gland would define the dispensing opening, rather than the cardboard tear-out, because the film gland defines the smallest opening through which the pre-formed sheet must pass to be dispensed through the dispensing opening. In the illustrated embodiment, the cardboard tear-out defines the dispensing opening because there is not film gland that defines a smaller opening, and moreover, the hole provided by the cardboard tear-out is the smallest opening through which the sheet passes as it is dispensed.

Each of the plurality of discrete plastic sheets 105 has a length L2 along the longitudinal axis LA, and the sheets are packaged in the package enclosure 103 such that the lengths L1, L2 are parallel. In an exemplary embodiment, the length L1 of the dispensing opening is less than the length L2 of the discrete plastic sheets but greater than one-half of the length L2 of the discrete plastic sheets (e.g., the length L1 is 70-98% of the length L2). As will be explained in further detail below, the inventors have discovered that openings of this length can reliably facilitate one-at-a-time dispensing of the discrete plastic sheets. In the illustrated embodiment, the dispensing opening structure 107 defines a dispensing opening with an elongate rectangular portion that defines the length L1 and a widened (e.g., rounded) central portion connected to the middle of the elongate rectangular portion. Other dispensing opening structures can define dispensing openings of other shapes without departing from the scope of the disclosure.

Figure 3:
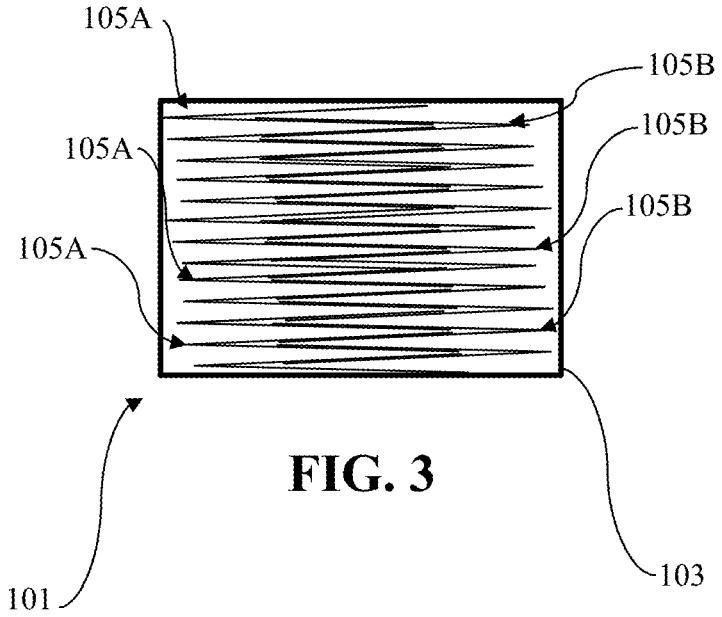
FIG. 3 is a cross section of the sheet product package in which the discrete plastic sheets are stacked in an interfolded stack.

The plurality of discrete plastic sheets 105 are arranged in a stack and disposed within the package enclosure 103. As shown in FIG. 3, in an exemplary embodiment, the package 101 comprises a plurality of discrete plastic sheets 105A, 105B arranged in an interfolded stack. The interfolded stack includes a first set of discrete plastic sheets 105A and a second set of discrete plastic sheets 105B. Each of the interfolded sheets 105A, 105B is folded in half along a lengthwise crease. The first set of discrete plastic sheets 105A is arranged with the lengthwise creases on a first side of the package enclosure 103 and the second set of discrete plastic sheets 105B is arranged with the creases on an opposite second side of the package 103. The first and second sets of discrete plastic sheets 105A, 105B are interleaved such that the sheets from the first set of discrete plastic sheets and sheets from the second set of discrete plastic sheets alternate along the stack. Each sheet 105A, 105B has a lower section and an upper section divided by the respective crease. Each sheet also has an inward facing side and an outward facing side. The inward facing side faces upward along the lower section of the respective sheet 105A, 105B and downward along the upper section of the respective sheet. Conversely, the outward facing side faces upward along the upper section of the respective sheet 105A, 105B and downward along the lower section of the respective sheet.

In certain embodiments, each discrete plastic sheet 105A, 105B includes a charged side and an opposite side opposite the charged side. For instance, in one or more embodiments, only the inward facing side of each of the discrete plastic sheets 105A, 105B has a greater electrostatic charge than the outward facing side. The effect of this configuration is that the inward facing sides of adjacent sheets 105A, 105B are (relatively) strongly bonded together by electrostatic charge, whereas the outward facing sides are loosely stacked. In an exemplary embodiment, the sheets 105A, 105B have electrostatic charge in an inclusive range of from 3 KV to 20 KV, for example, in an inclusive range of from 5 KV to 15 KV or in an inclusive range of from 7 KV to 10 KV.

In use, the sheet product package 101 allows for a first discrete plastic sheet 105A to be drawn out of package enclosure 103 without a second discrete plastic sheet falling back into the enclosure or creating a long chain of (e.g. three or more) clinging-together sheets. When the sheet product package 101 is new, the user reaches into the package enclosure 103 through the dispensing opening structure 107 for a first time to retrieve the first discrete plastic sheet 105A in the package enclosure. The user pulls the first discrete plastic sheet 105A through the dispensing opening structure 107. As the discrete plastic sheet 105A is drawn through the dispensing opening structure, the edges of the package enclosure 103 defining the opening structure constrict and deform the discrete plastic sheet. In order to successfully remove the first discrete plastic sheet 105A from the package enclosure 103, the user must apply a force greater than the resistance being applied by the package enclosure. As the first discrete plastic sheet 105A is pulled through the dispensing opening 107, it clings to the second sheet 105B immediately below it in the stack due to the electrostatic force of attraction between the inward facing sides of sheets. This pulls the second discrete plastic sheet 105B partially through the dispensing opening structure 107. The dispensing opening structure 107 sufficiently constricts the second discrete plastic sheet 105B within the opening to cause the first sheet 105A to release from the second sheet. Thus, after the first discrete plastic sheet 105A is fully dispensed, the second discrete plastic sheet 105B is held in the dispensable opening structure 107 in a ready-to-dispense configuration.

An exemplary method of making the above-described dispensable plastic sheets and packages will now be briefly described. In general, the process involves steps of (i) forming electrostatically charged discrete plastic sheets and (ii) arranging the electrostatically charged discrete plastic sheets in a stack inside a package enclosure.

Figure 4:
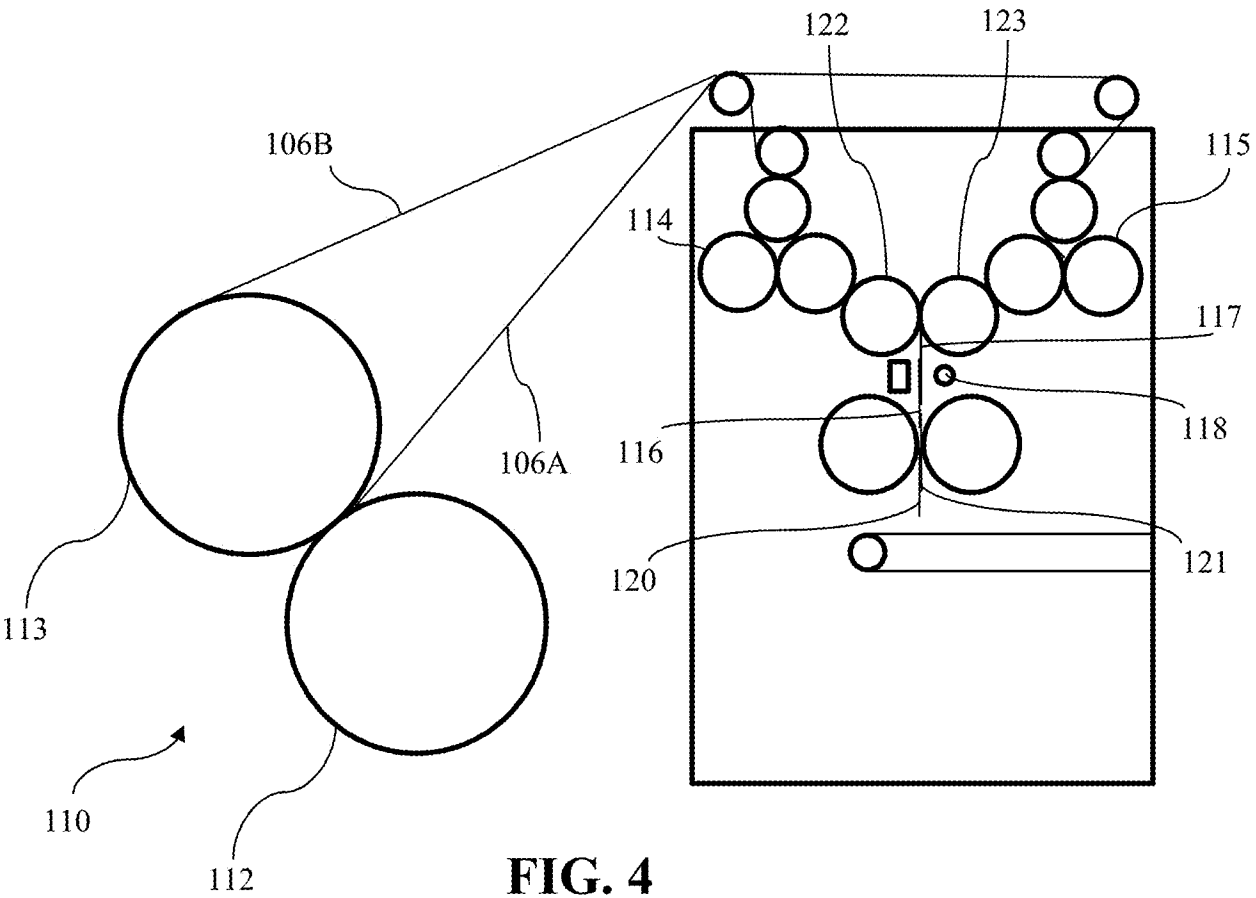
FIG. 4 is a schematic illustration of a sheet forming process.

Referring to FIG. 4, in one exemplary embodiment, the step of forming electrostatically charged discrete plastic sheets is performed in a sheet forming process 110, illustrated schematically. In the illustrated process 110, two rolls 112, 113 of continuous plastic film 106A, 106B (e.g., polyolefin film with substantial filler content) are used. The process 110 feeds continuous film 106A, 106B from each of the rolls 112, 113 to respective cutters 114, 115 (e.g., a cutting rollers), which cut each continuous film into a respective series of discrete plastic sheets 116, 117. The two series of discrete plastic sheets 116, 117 are fed in parallel, one-sheet-after-another, through an electrostatic charger 118. In the illustrated process 110, a first vacuum roller 122 and second vacuum roller 123 respectively transport the discrete plastic sheets 116, 117 from the respective cutting roller 114, 115 to the electrostatic charger 118. The rollers 122, 123 press the inward facing sides of the sheets 116, 117 together as they travel through the electrostatic charger. The electrostatic charger 118 includes an electrostatic charging element (schematically represented as a rectangle) and a ground element (schematically represented as a circle) that function to pin the sheets 116, 117 together. The electrostatic charge on the outward facing sides of the sheets 116, 117 dissipates quickly since the outward facing sides are exposed to ambient. By contrast, the inward facing sides of the sheets 116, 117 are pinned together and therefore are not exposed to ambient. Thus, the electrostatic charge on the inward facing sides remains. The electrostatic charger 118 forms electrostatically charged sheets 120, 121 having inward facing sides bonded together by the force of attraction of electrostatic charge.

Figure 5:
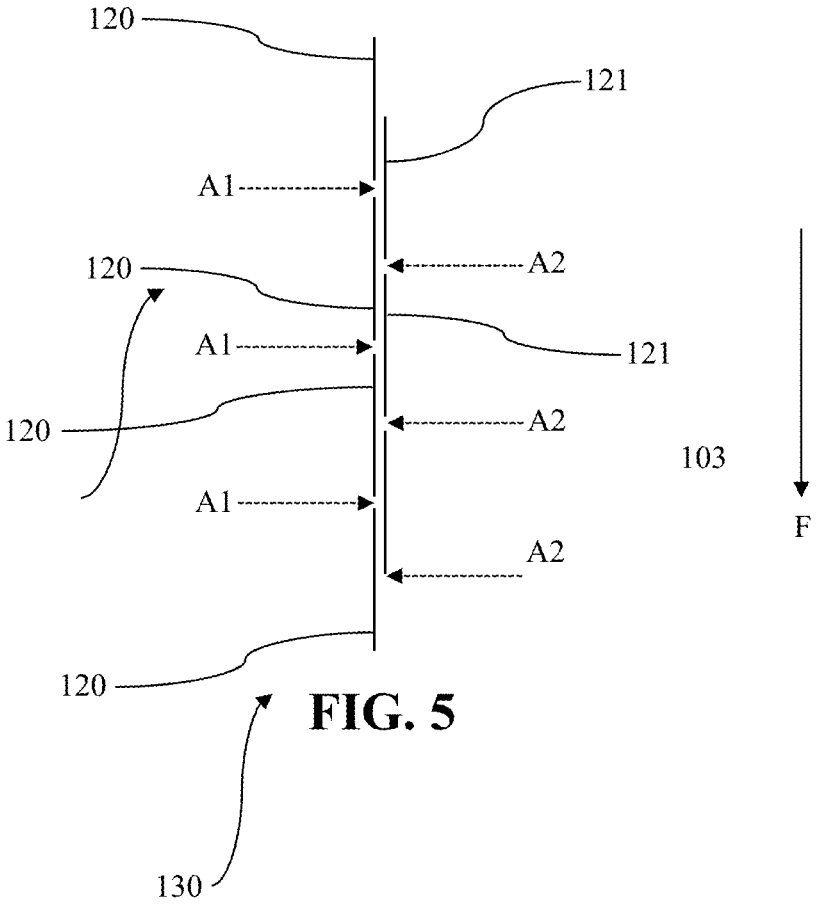
FIG. 5 is a schematic illustration of a process for folding dispensable discrete plastic sheets; and Corresponding reference numbers indicate corresponding parts throughout the drawings.

A set of output rollers outputs parallel first and second series of electrostatically charged discrete plastic sheets 120, 121 to an interfolding stacking process 130, shown in FIG. 5. The sheets 120, 121 are fed through the interfolding process 130 in a feed direction F extending in a widthwise direction of the sheets perpendicular to a lengthwise direction of the sheets. The sheets in each series are fed so that a leading side edge of each sheet 120 in the first series is offset from the leading side edge of an adjacent sheet 121 in the second series in a feed direction. Likewise, the trailing side edge of each sheet 120 in the first series is offset from the trailing side edge of an adjacent sheet 121 in the second series. As the sheets 120, 121 are fed through the interfolding stacking process 130, as indicated by the schematic arrow A1, a first folder folds each second sheet 121 along a lengthwise crease located at a widthwise location between the trailing edge of one sheet 120 in the second series and the leading edge of the immediately trailing sheet in the first series. Likewise, as represented by the schematic arrow A2, a second folder folds each of first sheet 120 along a lengthwise crease located at a widthwise location between the trailing edge of one sheet 121 in the second series and the leading edge of the immediately trailing sheet in the series. In the illustrated embodiment, the first and second folders are configured to fold the sheets 120, 121 such that the inward facing sides of the folded sheets are electrostatically charged and the outward facing sides of the folded sheets are non-charged.

It can be seen that the interfolding stacking process 130 creates a stack of interfolded electrostatically charged discrete plastic sheets. The interfolded stack can be packaged into a package enclosure in accordance with any suitable packaging process. In an exemplary embodiment, the package enclosure is formed with a dispensing opening structure having a length running parallel to the length of each of the interfolded sheets, wherein the length of the dispensing opening is less than the length of the interfolded sheets but greater than one-half of the length of the sheets.

EXAMPLES

A series of tests were conducted in which stacks of discrete plastic sheets with varying characteristics were placed into cardstock packages with dispensing openings of different lengths. The sheets were then pulled through the dispensing opening as one would conventionally pull a tissue from a tissue box. The conditions of each experiment and results are described below.

In a first test labeled C1 in Table 1 below, a package enclosure design was used wherein the dispensing opening structure length L1 was 100% of the length L2 of the discrete plastic sheets. The discrete plastic sheets in test C1 were not electrostatically charged. The discrete plastic sheets were folded in half along lengthwise creases and placed in the package enclosure as an interfolded stack.

In a second test labeled C2 in Table 1 below, a package enclosure was used wherein the dispensing opening structure length L1 was 100% of the length L2 of the discrete plastic sheets. The discrete plastic sheets were not electrostatically charged. The discrete plastic sheets were folded into three sections along lengthwise creases and placed in the package enclosure in an interfolded stack.

In a third test labeled C3 in Table 1 below, a package enclosure was used wherein the dispensing opening structure length L1 was less than 70% of the length of the discrete plastic sheets L2. The discrete plastic sheets in test C3 were electrostatically charged. The discrete plastic sheets were folded in half along lengthwise creases and placed in the package enclosure as an interfolded stack.

In a fourth test labeled C4 in Table 1 below, a package enclosure was used wherein the dispensing opening structure length L1 was 100% of the length L2 of the discrete plastic sheets. The discrete plastic sheets in test C3 were electrostatically charged. The discrete plastic sheets were folded in half along lengthwise creases and placed in the package enclosure as an interfolded stack.

In a fifth test labeled C5 in Table 1 below, a package enclosure was used wherein the dispensing opening structure length L1 is between 70% and 98% of the length of the discrete plastic sheets L2. The discrete plastic sheets in L3 were electrostatically charged. The discrete plastic sheets were folded in half along lengthwise creases and placed in the package enclosure as an interfolded stack.

The results from tests C1, C2, C3, C4, C5 are summarized in Table 1. In test C1, after drawing between one and four dispensable plastic sheets, the following dispensable plastic sheet remained within or fell back within the package enclosure. In test C2, the following dispensable plastic sheet remained or fell back within the package enclosure after nearly every prior sheet was drawn out of the package enclosure. The inventors believe that this is due to the lack of electrostatic charging in the discrete plastic sheets. Without the electrostatic charging, the force used to pull a following sheet into the dispensing opening structure is only friction, which, due to the low COF of plastic sheets, is insufficient to pull the following sheet (which is relatively dense in comparison with tissue paper) through the opening. Because the dispensable plastic sheets frequently and unpredictably continued to stay within the package enclosure, users were required to reach their hand into the package enclosure via the dispensing opening structure to retrieve the next dispensable plastic sheet. This could result in the contamination of the remaining dispensable plastic sheets in the package enclosure.

In test C3, the results showed that after drawing between four and eight dispensable plastic sheets, the following dispensable plastic sheet remained within or fell back within the package enclosure. The inventors believe this is due to the dispensing opening being overly narrow. In addition, the following dispensable plastic sheet would occasionally be disconnected from the prior dispensable plastic sheet due to the increased resistance of the narrower dispensing opening structure when compared to the electrostatic force and friction between dispensable plastic sheets. This may create the contamination problem as mentioned with the results of tests C1 and C2. Additionally, the entire package enclosure was observed as being lifted and tilted by as the dispensable plastic sheet was drawn. This is an undesirable occurrence and becomes more significant and frequent when the package enclosure is close to being emptied of dispensable plastic sheets.

In test C4, the results showed that when drawing on the first dispensable plastic sheet, the electrostatic force between the dispensable plastic sheets caused multiple sheets to be drawn out of the package enclosure in a continuous chain. This is due to the fact that the wider opening does not apply any resistance to the dispensable plastic sheets as they exit the package enclosure via the dispensing opening. In order to separate a prior dispensable plastic sheet from the following dispensable plastic sheet, the user must grip both the prior dispensable plastic sheet with one hand and the following dispensable plastic sheets with the other hand and manually draw the dispensable plastic sheets apart. This results in a waste of dispensable plastic sheets and a messier workspace.

In C5, the results showed that after each dispensable plastic sheet was removed from the package enclosure, the following dispensable plastic sheet was positioned in a ready-to-dispense configuration. This was due to the fact that the length of the dispensing opening structure provides resistance sufficient to overcome the electrostatic charge force between the dispensable plastic sheets as the following dispensable plastic sheet enters the dispensing opening structure. However, the resistance is not so large as to prevent the electrostatic force between the prior dispensable plastic sheet and the following dispensable plastic sheet from drawing the following dispensable plastic sheet partially out of the package enclosure via the dispensing opening structure. This results in the following dispensable plastic sheet being easily accessible to the user without the user having to reach into the package enclosure and potentially contaminating the remaining dispensable plastic sheets. In addition, it prevents extended chains of three or more dispensable plastic sheets from being drawn out of the package enclosure.

TABLE 1

| Test | Electrostatic Charge | Folding | L1 = X % L2 | Result |
|---|---|---|---|---|
| C1 | No | Halves | 100% | After drawing between one (1) and four (4) sheets, the next sheet remained within the package enclosure |
| C2 | No | Thirds | 100% | After each sheet, the next sheet remained within the package enclosure |
| C3 | Yes | Halves | <70% | After drawing between of four (4) and eight (8) sheets, the next sheet remained within the package enclosure |
| C4 | Yes | Halves | 100 | Sheets had to be manually pulled apart |
| C5 | Yes | Halves | 70% < X < 98% | Each sheet dispensed independently and ready for the next sheet to be dispensed |

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively, or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention are not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

In view of the above, it will be seen that several advantages of the aspects of the invention are achieved and other advantageous results attained.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

What is claimed is:

1. A sheet product package, the sheet product package comprising:

a package enclosure, the package enclosure including a dispensing opening structure; and a plurality of discrete plastic sheets arranged in a stack, the plurality of discrete plastic sheets being disposed within the package enclosure, wherein each of the plurality of discrete plastic sheets is electrostatically charged;

wherein the plurality of discrete plastic sheets includes a first set of discrete plastic sheets and a second set of discrete plastic sheets and wherein the first and second sets of discrete plastic sheets are interfolded such that the sheets from the first set of discrete plastic sheets and sheets from the second set of discrete plastic sheets alternate along the stack;

wherein each of the discrete plastic sheets has an inward facing side and an outward facing side; and wherein the inward facing side of each of the discrete plastic sheets has a greater electrostatic charge than the outward facing side of each of the discrete plastic sheets.

2. A sheet product package as set forth in claim 1, wherein each of the plurality of discrete plastic sheets is electrostatically charged in a range from 3 KV to 20 KV.

3. A sheet product package as set forth in claim 1, wherein the inward facing sides of the discrete plastic sheets in the first set of discrete plastic sheets are bonded to the inward facing sides of the discrete plastic sheets in the second set of discrete plastic sheets by electrostatic charge and the outward facing sides are loosely stacked.

4. A sheet product package as set forth in claim 1, wherein the dispensing opening structure is configured to define an elongate opening having a length extending along a longitudinal axis, wherein each of the plurality of discrete plastic sheets has a length along the longitudinal axis, and wherein the length of the dispensing opening is 70-98% of the length of each of the plurality of discrete plastic sheets.

5. A sheet product package as set forth in claim 1, wherein the discrete plastic sheets are comprised of a polyolefin material.

6. A method of making dispensable plastic sheets, the method comprising:

forming electrostatically charged discrete plastic sheets; and arranging the electrostatically charged discrete plastic sheets in a stack;

wherein each of the discrete plastic sheets has an inward facing side and an outward facing side and wherein the inward facing side of each of the discrete plastic sheets has a greater electrostatic charge than the outward facing side of each of the discrete plastic sheets.

7. A method as set forth in claim 6, wherein the step of forming comprises:

forming a continuous plastic film;

cutting the continuous plastic film into discrete plastic sheets; and after said cutting, electrostatically charging the discrete plastic sheets.

8. A method as set forth in claim 6, wherein the step of forming the electrostatically charged discrete plastic sheets comprises forming first and second sets of electrostatically charged discrete plastic sheets from first and second continuous plastic films in a parallel sheet forming process.

9. A method as set forth in claim 8, wherein the parallel sheet forming process comprises cutting the first and second continuous plastic films into first and second series of discrete plastic sheets, respectively, and then electrostatically charging the first and second series of discrete plastic sheets.

10. A method as set forth in claim 9, wherein the parallel sheet forming process comprises feeding the first and second series of discrete plastic sheets through an electrostatic charger with inward facing sides of the first and second series of discrete plastic sheets pressed against one another.

11. A method as set forth in claim 10, wherein the arranging step comprises interfolding the first and second series of electrostatically charged discrete plastic sheets after the parallel sheet forming process.

12. A method as set forth in claim 6, the method further comprising forming a package enclosure and receiving the stack of electrostatically charged discrete plastic sheets in the package enclosure.

13. A method as set forth in claim 12, wherein forming the package enclosure further comprises forming a dispensing opening structure in the package enclosure, the dispensing opening structure being configured to define an elongate dispensing opening having a length along a longitudinal axis.

14. A method as set forth in claim 13, wherein receiving the stack comprises arranging the stack in the package so that each of the electrostatically charged discrete plastic sheets has a length extending parallel to the longitudinal axis, wherein the length of the opening is from 70-98% of the length of the electrostatically charged discrete plastic sheets.

15. A sheet product package as set forth in claim 6, wherein each of the discrete plastic sheets has an electrostatic charge of from 3 KV to 20 KV.

* * * * *